United States Patent [19]

Guido et al.

[11] Patent Number: 4,717,082

[45] Date of Patent: Jan. 5, 1988

[54] FIXED ROLLER PULVERIZING MILL

[75] Inventors: Paul V. Guido, Cedar Grove; Chester J. Romanowski, Carteret; William D. Stevens, North Caldwell, all of N.J.

[73] Assignee: Foster Wheeler Energy Corporation, Clinton, N.J.

[21] Appl. No.: 544,806

[22] Filed: Oct. 24, 1985

Related U.S. Application Data

[63] Continuation of Ser. No. 208,010, Nov. 18, 1980, abandoned, which is a continuation of Ser. No. 973,987, Dec. 28, 1978, abandoned.

[51] Int. Cl.[4] ..... B02C 15/04

[52] U.S. Cl. ..... 241/121

[58] Field of Search ..... 241/117, 121

[56] References Cited

U.S. PATENT DOCUMENTS

| | | | |
|---|---|---|---|
| 1,478,478 | 12/1923 | Kreutzberg . | |
| 2,342,555 | 2/1944 | Doyle | 83/45 |
| 2,698,142 | 12/1954 | Crites et al. | 241/53 |
| 3,730,446 | 5/1973 | Piepho | 241/110 |
| 3,822,829 | 7/1974 | Brundiek et al. | 241/121 |
| 3,881,348 | 5/1975 | Morton | 241/121 X |
| 3,899,965 | 8/1975 | Koch et al. | 100/155 |
| 4,049,206 | 9/1977 | Konig et al. | 241/73 |

*Primary Examiner*—Timothy V. Eley

*Attorney, Agent, or Firm*—Marvin A. Naigur; Richard L. Aitken

[57] ABSTRACT

A fixed roller pulverizing mill wherein there is comparatively little wear, vibration or other adverse characteristics and wherein a uniform fineness of the ground material is maintained. The rollers, which do not move substantially in a horizontal direction, bear down on a rotating table, contacting the table at a circular trough therein and are individual spring biased to improve the performance of the mill.

6 Claims, 4 Drawing Figures

FIXED ROLLER PULVERIZING MILL

This is a continuation of Ser. No. 208,010, filed Nov. 18, 1980, now abandoned, which is a continuation of Ser. No. 973,987, filed Dec. 28, 1978, now abandoned.

BACKGROUND OF THE INVENTION

There are several common uses for mills which are used to pulverize solids. One example is the pulverization of coal to prepare it for firing in a furnace.

One type of mill, commonly known as a ball mill, as its name implies, uses large metal balls to pulverize the material. Ball mills are generally reliable but have several disadvantages. For any given quantity of coal or other material to be pulverized they are comparatively large and therefore require a rather large capital expenditure. Further, they consume much energy in their operation.

When a less expensive will is required, roller mills are often employed. Roller mills which are presently used to pulverize coal generally employ several rollers which bear down on a rotating table onto which the coal is fed to pulverize the coal. In some designs, the rollers have flat tread portions which tend to wear unevenly over a period of time. This results in a pulverized coal in which the particulate size is not uniform. Other designs have structure which urge the rollers down against the rotating table in such a way that when the coal between the table and roller exerts an upward force on a roller, the other rollers are jostled. The result is the creation of vibration during operation and a consequent excessive degree of wear and a loss of efficiency.

In other designs, the rollers begin to yaw after a period of operation because of wear in the parts which are designed to guide the rollers. This creates excessive rolling friction so that the rollers often skid over the table rather than roll over it. When this happens, the skidding roller is not pulverizing the coal properly, and consequently the efficiency of the mill quickly deteriorates.

SUMMARY OF THE INVENTION

It is an object of the present invention to overcome drawbacks found in the prior art such as those discussed above. Accordingly, a roller mill is provided with a rotating table and a plurality of rollers which bear down on the table at a circular trough therein. Each of the rollers are individually spring biased down against the table so that movement of the axis of rotation of one of the rollers will not affect any of the other rollers.

DETAILED DISCRIPTION OF THE PREFERRED EMBODIMENT

Figure 1:
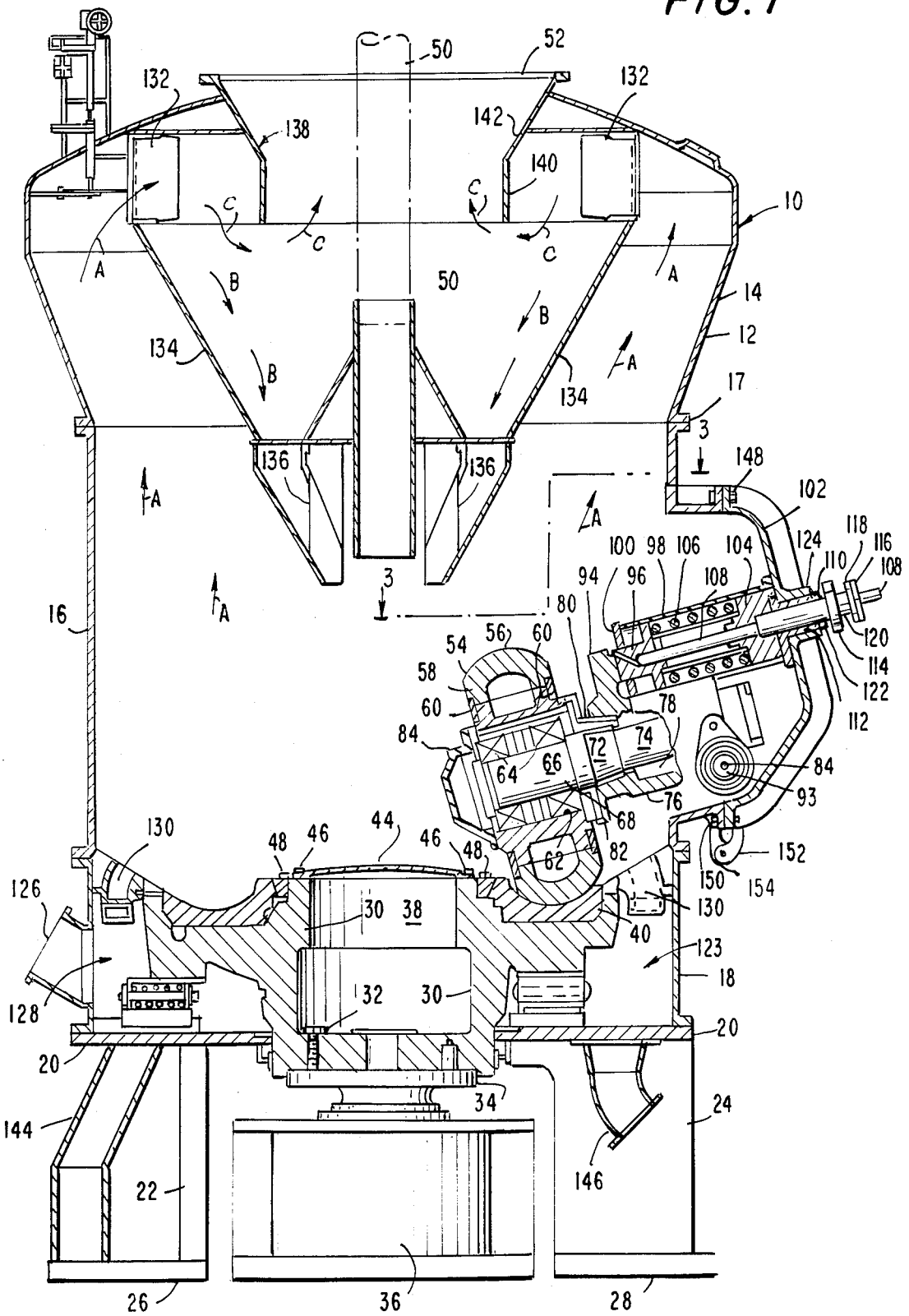
FIG. 1 is a side view partly in section showing a pulverizing mill made in accordance with the present invention.

FIG. 1 shows a coal pulverizing mill indicated generally as 10 having an outer shell 12 which has a upper portion 14, which is joined to a middle portion 16 at a flange seam 17 and a lower portion 18. The shell 12 is mounted on a platform which in turn is supported on legs 22 and 24 which extend upwardly from footing 26 and 28 respectively. Located within the shell 12 is a circular table 30 which is mounted as by bolts 32 on a wheel 34 which is rotated by a motor 36 directly below the wheel 34. The table 30 which has a hollow center portion 38 includes an annular track 40 of wear resistance material which may be hard steel. The track 40 is recessed at 42. A cover 44 bridges the hollow center portion 38 to prevent particulate matter from entering the hollow portion 38.

The cover 44 is secured to the table 30 by bolts 46 and the annular track 40 is secured to the table by bolts 48 so that the cover 44 and track 40 rotate with the table 30 when it is turned by the motor 36.

Unpulverized coal is introduced into the mill through a coal pipe 50 which extends down through the top 52 of the mill 10 to a location above the center of the table 30. The coal falls on the table to be moved radially outward by centrifugal force to the annular track 40. The coal then passes between the track 40 and rollers 54, which bear down on the track 40, within the recess 42. Although the preferred embodiment employs several rollers 54, only one is shown in FIG. 1 for the sake of simplicity.

The roller 54 has a tread portion 56 which is curved in cross section so that it has the shape of the outer portion of a torus. The tread 56 is the peripheral surface of a tire portion 58 which is made of hardened metal and which is secured to a wheel portin 60 positioned within the tire portion 56. The roller 54 includes an outer race 62 which rotates about bearings 64 which in turn rotate about an axle 66. The axle 66 includes a journal portion 68 which in effect forms the inner race for the bearings 64 and an increased diameter portion 70 positioned between the journal portion 68 and a tapered portion 72. The tapered portion 72 is integrally connected to the end of a shaft portion 74. The axle 66 is mounted rigidly with a support 76. The rigid connection between the axle 66 and the support 76 is accomplished by a press fit between the support 76 and the tapered portion 72.

The shaft portion 74 is of a diameter small enough to define between it and the support 76 an annular chamber 78 which is supplied with seal air of sufficient pressure so that air will flow from the chamber 78 through a port 80 to an annular space behind a cover 82 so that air will constantly flow out from between the cover 82 and the wheel portion 60 of the roller 54. This will prevent coal dust from getting into the bearings 64. Seal air is provided only at the outer side at the roller 54 because the inner side can be protected by a cover 83 which is fixed to the wheel portion 60 to prevent coal dust from entering the bearings from the inner end of the wheel 54.

Figure 2:
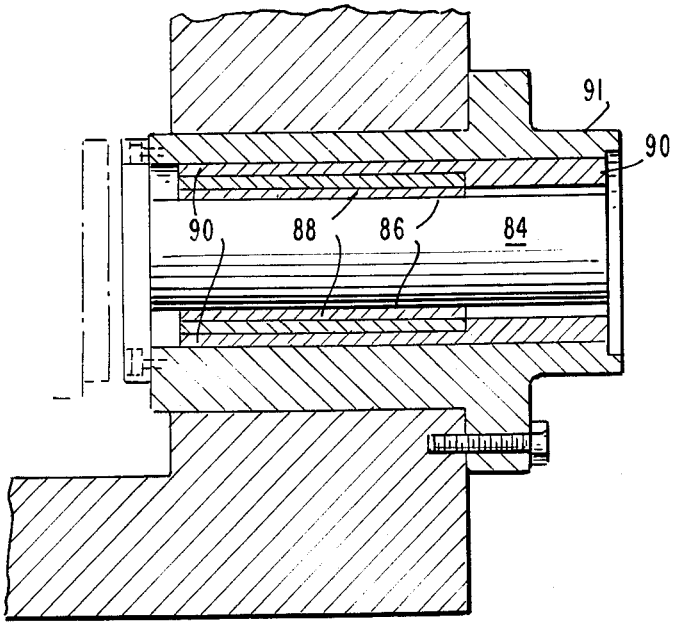
FIG. 2 is a view partly in section and in larger scale than is FIG. 1 showing a detail of the preferred embodiment.

The wheel support 76 is mounted on a shaft 84 which at each of its ends is rigidly fixed to and concentric with a sleeve 86 as shown best perhaps in FIG. 2. The sleeve 86 is force fitted onto the shaft 84 and is itself encircled by a flexible bushing 88 which is force fitted on the sleeve 86. An outer sleeve 90 is force fitted around the flexible bushing 88 and is itself fitted in a journal 91 and secured therein against rotation as by welding. The journal 91 is mounted in an opening in the outer shell 12 and secured thereto by bolts 92, as shown in FIG. 2.

The seal air is supplied through a channel 93 in the shaft 84, and escapes through openings therein within the support 76 so that seal air will flow into the chamber 78.

Figure 3:
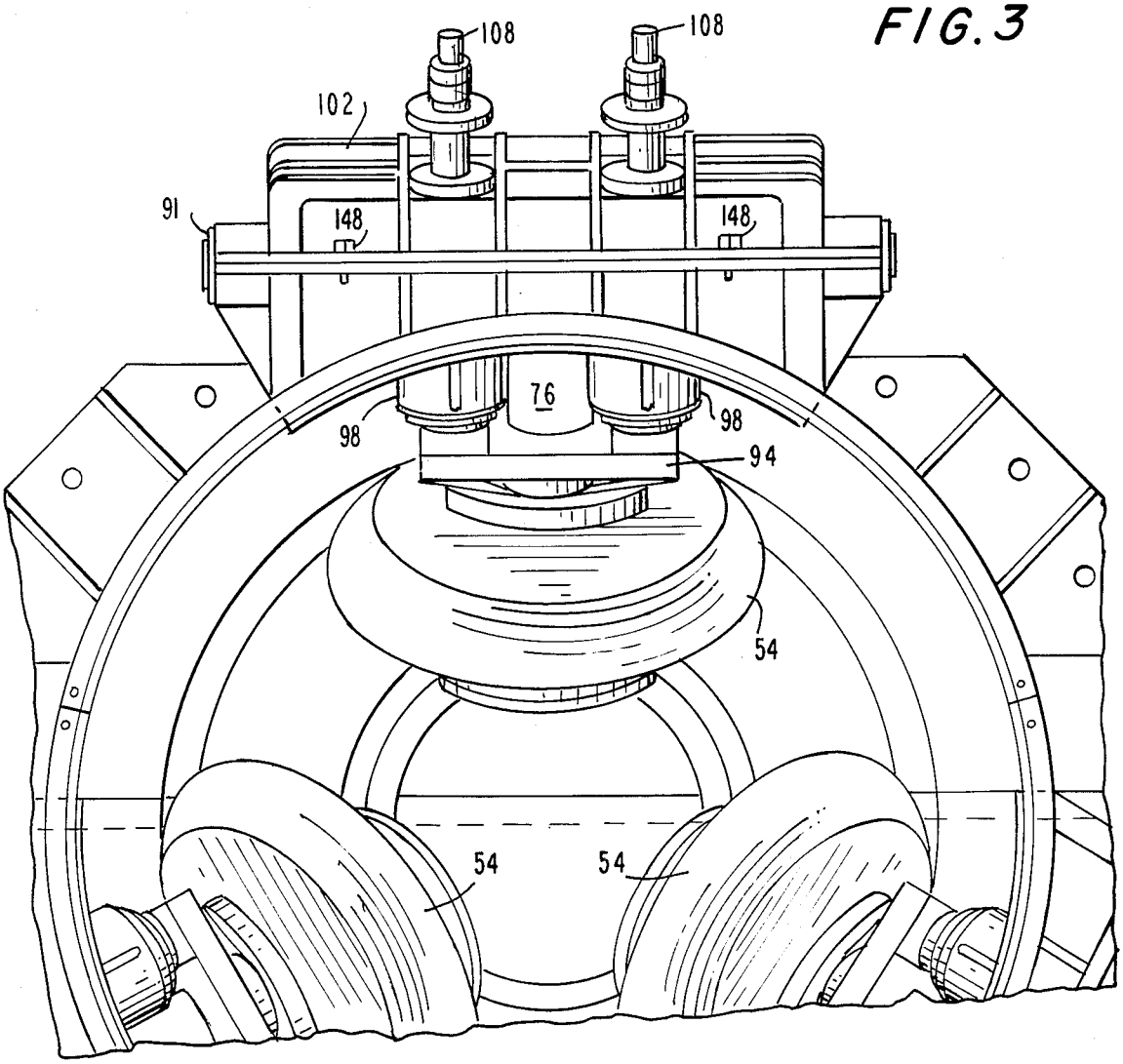
FIG. 3 is a plan view partly in section taken substantially along the line 3—3 of FIG. 1.

It has been explained that the support 76 is biased downwardly against the table 30. To this end the support includes an upwardly extending lug 94 which is acted upon by plungers 96 each of which is slideable mounted within one of two spring housings 98. Each spring housing 98 includes at one end a circular plate 100 having a centrally located opening through which projects the plunger 96. Both spring housings 98 are shown in FIG. 3 while one is shown in section in FIG. 1.

The spring housings 98 are fixed to the outer shell 10 at an access door 102 and are spaced apart in a direction perpendicular to the axis of the associated roller 54. Also within the spring housing 98 is a axially moveable spring base 104. Coil spring 106 is positioned between the plunger 96 and the spring base 104 to urge the plunger 96 against the lug 94.

It has been explained that coal introduced through the coal pipe 50 passes between the roller 54 and the table 30. It is desirable that the roller 54 be allowed to oscillate vertically to allow for nonuniform distribution of coal below it and for variation in the particulate size of the coal being pulverized. This is possible because the flexible bushing 88 allows the shaft 84 to oscillate with respect to the journal 91 so that vertical movement of the roller is facilitated by a pivotal action of the support 76 about the axis of the shaft 84. Upward movement of the roller 54 will be resisted because as the roller 54 moves upward, the lug 94 will move the plunger 96 to the right (as shown in FIG. 1) against the action of the coil spring 106.

It is desirable to be able to adjust to force exerted on the lug 94 by each of the coil springs within spring housings 98 at the time when the roller 54 is bearing directly against the table 30 that is when no coal is between the roller 54 and the table 30. This is so because when no coal is being pulverized, excessive wear will result if the roller bears down directly against the table 30 with excessive force. Adjustment of the force exerted by the coil spring 106 when the roller 56 is bearing directly on the table 30 is controlled by means of a shaft 108 which is secured to the plunger 96 and which is threaded through a sleeve 110 which in turn is threaded through a bushing 112 which is secured to the access door 102. The bushing 112 is fixed to the spring base 104 so that axial movement of the bushing 112 will move the spring base 104 axially within the spring housing 98.

The bushing 112 can be turned by means of a turning nut 114 which is secured to it. The shaft 108 can be turned by means of a turning nut 116 which is fixed to the shaft 108.

When it is desired to adjust the spring force, which is applied against the lug 94 when the roller 54 is bearing directly against the table 30, the nut 116 is rotated. Rotation of the nut 116 turns the shaft 108 and since the shaft is threaded with the sleeve 110 the shaft 108 is moved axially. This moves the plunger 96 axially. It is possible to adjust the plunger 96 so that it just touches the lug 94 when the roller 54 is bearing directly on the table 30, that is, when there is no coal on the table 30 under the roller 54. It is also possible to adjust the plunger 96 so that there is a gap between it and the lug 94.

After the plunger 96 has been adjusted as desired, a locking nut 118, which is threaded to the shaft 108, is tightened against a bushing 120 which is positioned between locking nut 118 and the turning nut 114.

At times it is desirable to adjust the position of the spring base 104. For example, it may be found that for particular coals the force exerted on the roller 54 by the spring 106 at any given position of the roller 54 should be increased or decreased. This is made possible by turning the turning nut 114 to move the sleeve 110 axially in the desired direction to position the spring base 104. The sleeve 110 and the spring base 104 are fixed in position by means of a locking nut 122 which is threaded on the sleeve 110 and is turned against washer 124 which bears against the bushing 112. After the spring base 104 is positioned, the plunger 96 can be adjusted in the manner previously described.

Coal drops down the coal pipe 50 to impinge on the cover 44 and move radially outward because of the centrifugal force exerted by the rotating table 30. The coal passes into the recess 42 to be pulverized by the rollers 54 which are rotating over the coal within the recess 42. The shape of the tread portion 56 of each roller 54 and the shape of the recess 42 tend to confine for a time the coal which is between the roller 54 and the recess 42 so that particles which are not contacted by the roller 54 and table 30 are exposed to pressure. The pressure is high enough to break down coal particles and thus pulverize them even when they are not contacted directly by the roller 54 and table 30.

The pulverized coal is blown upward by air which is introduced through a conduit 126. The air flows through an annular air chamber 128 and then up through air ports 130 into the space within the outer shell 12 above the table 30. The air then moves the pulverized coal upward in the direction of arrows "A" to pass through a series of vanes 132 which impart rotation to the mixture of air and coal around the longitudinal axis of the coal pulverizing mill 10. This acts as a centrifugal separator in that the heavier particles are thrown outward and eventually drop down in a housing 134 in the direction of the arrows "B". These coarse particles drop through doors 136 which are hinged and free to move inward as shown in phantom line under the weight of the coarse particles. The doors help prevent pulverized coal moving upward in the direction of the arrows "A" from passing into the housing 134.

The fine particles move inward and are entrained in air moving in the direction of the arrows "C" to pass up through a coal collector 138 defined by a vertical annular plate 140 which is concentric with and joined to the bottom of an outwardly flared plate 142. The mixture consisting of air and coal fines passes upward through the top 52 to a conduit which is not part of the present invention and which conveys the mixture of pulverized coal fines and air to the point of use which may be a coal fired steam generator.

In practice some particles are large and heavy enough after passing over the table 30 that they cannot be raised by the air rushing upward from the air ports 130. Such particles are actually dropped down through the air ports 130 into the chamber 128. They then drop down through chutes 144 and 146 to be recycled into the coal pulverizing mill 10.

When it is desired to service the roller 54 of any of the parts associated with the support 76, bolts 148 and 150 are removed so that access door 102 can be swung outward. The access door 102 has fastened to its lower end a hinge element 152 which is rotatably connected to a hinge element 154 secured to the middle portion 16 of the outer shell 10. Rotation of the access door 120 outward and downward will move the spring housing 98 as well as the plunger 96 and other elements within the spring housing 98 outward away from the interior of the coal pulverizing mill 10. Any roller 54 can be swung out if its associated journals 91 are removed. As shown in FIG. 3, journals 91 are each positioned between an opening which extends into a side of the access door 102 and the main body of the middle portion 16 of the outer shell 12. In other words, the journal fits within a semicircular opening in the access door 102 and a corresponding semicircular opening the middle portion 16 of the outer shell 12.

Figure 4:
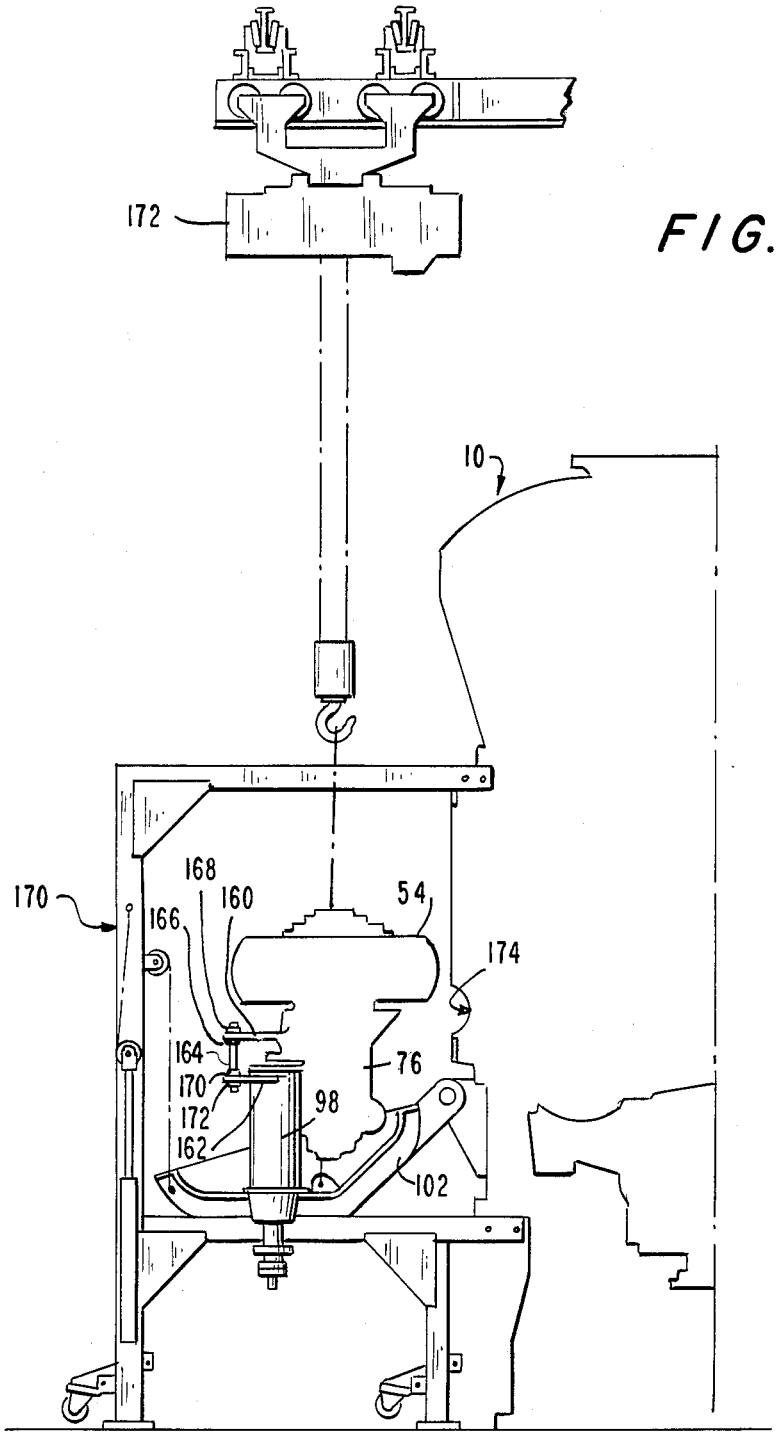
FIG. 4 is a view showing certain parts of the present invention positioned for servicing.

FIG. 4 shows a roller 54 and its associated supports 76 moved out for servicing. The support 76 has been provided with a bracket 160 which may be secured to it by bolting or welding or any other method. Similarly, the associated spring housing 98 has been provided with bracket 162. The brackets 160 and 162 are fastened together by a bolt 164 which is secured to the bracket 160 by nuts 166 and 168. Similarly, the bolt 164 is secured to the bracket 162 by nuts 170 and 171. When the support 76 is so secured to the roller 54, outward movement of the access door 102 will cause the spring housing 98 and the associated support 76 and roller 54 to move outward.

FIG. 4 shows a suitable apparatus 172 for moving the access door 102 out. It will not be described in detail because it is not part of the present pulverizing mill 10.

Further, a crane 173 can be used to provide additional support as the access door moves out and additional support is needed as the center of gravity of the access door, support 76 and roller 54, move out beyond the hinge about which the access door is pivoted.

FIG. 4 shows at 174 the semicircular opening in the middle portion 16 of the coal pulverizing mill 10 in which the shaft 84 is supported at one of the ends thereof. The shaft 84 and its associated journal 91 must be moved out of the semicircular opening 174 and the corresponding semicircular opening 174 in the associated journal 91 (not shown) to allow the support 76 to move to the position shown in FIG. 4. Once in this position, the roller 54 can be serviced. For instance, if excessively worn, the roller 54 can be replaced. The bearing 64 can be cleaned and lubricated as desired.

The foregoing describes part one preferred embodiment of the present invention other embodiments being possible without exceeding the scope of the present invention as desired in the following claims.

What is claimed is:

1. A coal pulverizing mill comprising:

an outer shell;

a horizontal table rotatably mounted within said shell, having an annular recess in the upper surface thereof, said recess being concave over the width thereof;

means to rotate said table;

means to place coal on said table;

a plurality of rollers above said table having a tread portion convex over the width thereof bearing on said table within said recess;

a plurality of supports, each of said rollers being rotatably mounted on one of said supports, each of said supports being pivotally mounted on said outer shell for upward and downward movement;

a plurality of spring means, each of said spring means being connected with said shell to exert a spring force only on one of the supports to urge the one of said rollers associated with said one support down against said table, each of said spring means comprising two springs, said two springs being spaced apart along the direction perpendicular to the axis of the associated roller, engaging their associated support on opposite sides of a vertical plane extending through the axis of rotation of the associated roller, and exerting a force on their associated support in a direction parallel to said axis of rotation;

whereby, when one of said rollers moves vertically, said movement has no effect on the others of said plurality of rollers and all of the rollers are biased to roll straight in the annular recess in the horizontal table.

2. The coal pulverizing mill defined in claim 1 further including means for introducing air into said shell to move pulverized coal upward and out of said mill.

3. The coal pulverizing mill defined in claim 2 further including means to separate coarse particles of pulverized coal from fine particles of pulverized coal being moved by said air, means to allow said fine particles to leave said pulverizing mill, and means to recycle said coarse particles onto said rotating table.

4. A pulverizing mill comprising:

an outer shell;

a table rotatably mounted within said outer shell, said table having an annular track including an annular recess;

means for rotating said table;

means for placing material to be pulverized on said table;

a plurality of rollers, each having a tread portion bearing on said table within said recess;

a plurality of supports, each having one of said rollers rotatably mounted thereon, each said support being pivotally secured to said outer shell for upward and downward movement; and a plurality of spring means, each spring means engaging one of the supports, but supported independently of said supports, to urge the associated roller toward said table, each of said spring means comprising two spring assemblies, said two spring assemblies being spaced apart along the direction perpendicular to the axis of the associated roller, engaging their associated support on opposite sides of a vertical plane extending through the axis of rotation of the associated roller, and exerting a force on their associated support in a direction parallel to said axis of rotation.

5. The pulverizing mill defined in claim 4, wherein each spring assembly comprises a spring housing fixed to the outer shell, a plunger slidable within the spring housing and projecting from the spring housing to engage said one of the supports, and a spring in the spring housing, said spring biasing the plunger into engagement with said support.

6. The pulverizing mill defined in claim 4, wherein each spring means comprises means for adjusting the force with which each roller is urged toward said table.

* * * * *